United States Patent [19]

Freier

[11] Patent Number: 4,761,971

[45] Date of Patent: Aug. 9, 1988

[54] JEWELRY COATING

[76] Inventor: Marilyn H. Freier, 889 Greenway Ave., North, St. Paul, Minn. 55119

[21] Appl. No.: 933,744

[22] Filed: Nov. 21, 1986

[51] Int. Cl.[4] ..... A44C 7/00; A44C 27/00

[52] U.S. Cl. ..... 63/12; 128/330; 427/429; 411/371; 428/457

[58] Field of Search ..... 63/12, 13, 3; 24/161, 24/155 R, 155 SD, 90.5; 427/429; 128/330; 411/373, 371; 428/461, 457

[56] References Cited

U.S. PATENT DOCUMENTS

| | | | |
|---|---|---|---|
| 2,209,000 | 7/1940 | Nutting | 570/248 |
| 2,748,171 | 5/1949 | Finch | 568/678 |
| 4,067,341 | 1/1978 | Ivey | 63/12 |
| 4,495,254 | 1/1985 | Hoffman | 63/3 |
| 4,593,540 | 6/1986 | Cuvar | 63/12 |
| 4,630,452 | 12/1986 | Connelly | 63/12 |
| 4,682,477 | 7/1987 | Vaillancourt | 63/12 |

FOREIGN PATENT DOCUMENTS

| | | | |
|---|---|---|---|
| 2581520 | 11/1986 | France | 63/12 |

*Primary Examiner*—Richard J. Johnson

*Attorney, Agent, or Firm*—Burd, Bartz & Gutenkauf

[57] ABSTRACT

A pierced earring having a metal body and post carries a coating of non-skin irritating plastic to shield the skin of a person from irritation. The coating is a mixture of trichlorethane, toulene, and methoxyethanol. A resilient annular member is mounted on the post to retain the earring on the earlobe of a person.

18 Claims, 1 Drawing Sheet

JEWELRY COATING

FIELD OF INVENTION

The invention is in the field of materials that do not irritate or react with human skin and adheres to metal to prevent contact of metal with skin. The material is a skin inert and non-allergic plastic that is applied to metal surfaces of objects such as jewelry, watches, and the like that are normally located in contact with a person's skin.

BACKGROUND OF INVENTION

A significant portion of a population have skin tissue that is irritated or reacts with metals such as the metals used in jewelry, watchbands, rings, and the like. The metal reaction of the person's skin is an irritant which precludes the continuous wearing of metal objects. The various attaching structures for jewelry have been used for pierced ears. Some of these structures includes metal wires and posts that are in direct contact with the skin. In humid climates, skin moisture and metal can react to chemically irritate the skin and produce a protein build-up on the metal that causes further skin reactions.

SUMMARY OF INVENTION

The invention is directed to a skin protective coating for a device adapted to be carried by a person adjacent the skin that normally causes reaction or skin irritation. The device includes jewelry, such as earrings, rings, and metal watchbands. The coating is a non-skin irritating plastic adapted to be applied in liquid form to the device to function as a shield to protect a person's skin from the metal parts of the device. The plastic is biologically inert transparent material that permanently adheres to a metal surface. The plastic is not susceptible to protein build-up and does not react with moisture or other body fluids as well as the skin tissue. One form of this plastic material includes a mixture of trichloroethane, toulene, and methoxyethanol.

An embodiment of the invention includes an earring for an ear having a portion thereof with a hole. The earring has a metal body with front and back sides. When the earring is attached to the ear, the front side is located away from the ear and the back side is located adjacent the ear. A post is secured to the back side of the body and extends in a generally normal direction for selectively traversing the ear through the hole therein. A non-metallic and non-skin irritating coating means is secured to the back side of the body and covers the post to shield the skin areas of the ear from the body and post of the earring. This prevents irritation and metal allergies of the skin due to the shielding of the metal from the skin. A non-skin irritating holder is slidably engaged over the coating means on the post to retain the earring on the ear. The holding means comprises a resilient annular member having a hole to accommodate the post and coating thereon. The hole has a size smaller than the transverse size of the post and coating so that the annular member deforms the coating means to prevent inadvertant separation of the annular member from the post. The annular member is preferably a rubber O-ring. The coating means is a transparent plastic that is applied in liquid form to the selected parts of the metal earring. The coating means adheres to metal and when dry is affixed to the metal. The plastic is biologically inert as it does not irritate or react with the skin tissue or body fluids. An example of the plastic material is a mixture of trichloroethane, toulene, and methozyethanol.

The coating material is easy to use and effective for protecting the skin from skin irritating jewelry such as earrings, rings, snaps, necklaces, watches, and watchbands. The plastic is preferably transparent so that it does not detract from the ornamental and beautification characteristics of the jewelry. These and other advantages of the jewelry coating of the invention are embodied in the following drawings and description of preferred embodiment and claims.

DESCRIPTION OF PREFERRED EMBODIMENT

Figure 1:
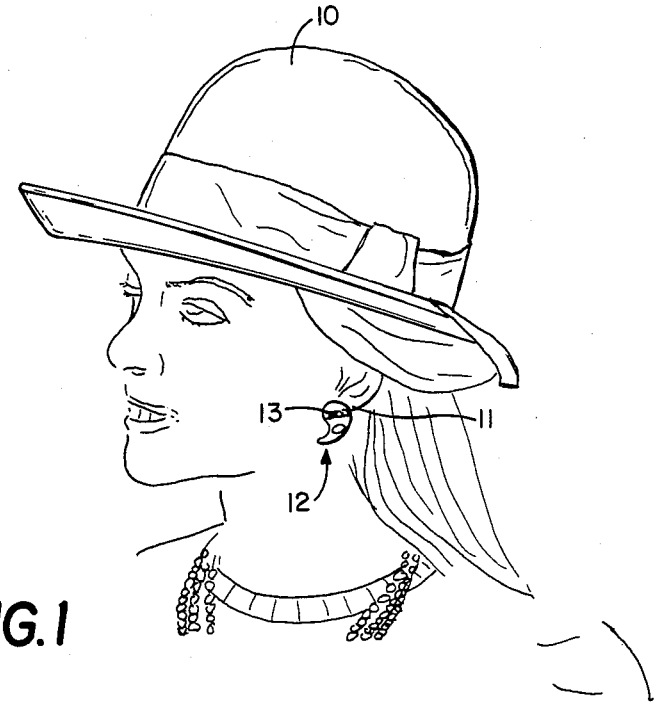
FIG. 1 is a diagrammatic view of a person wearing an earring according to the invention.
Figure 2:
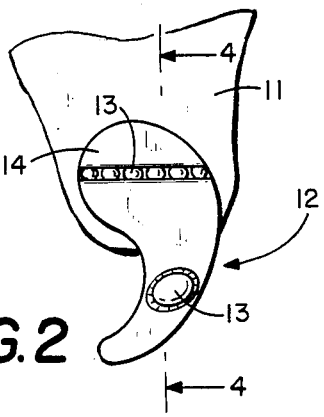
FIG. 2 is a enlarged front elevational view of the earring on the earlobe of the person.
Figure 3:
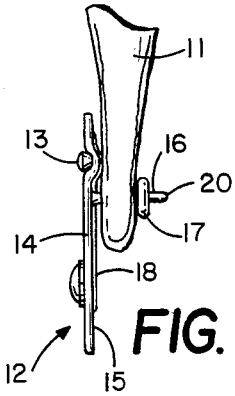
FIG. 3 is a side view of FIG. 2.
Figure 6:
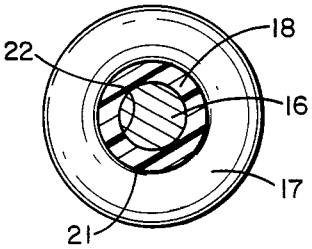
FIG. 6 is an enlarged sectional view taken along the line 6—6.
Figure 5:
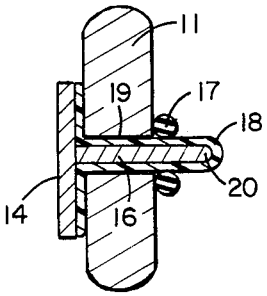
FIG. 5 is an enlarged sectional view taken along the line 5—5 of FIG. 4.
Figure 7:
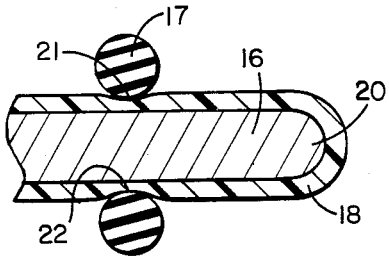
FIG. 7 is an enlarged sectional view of the holding end of the earring as shown in FIG. 5.

Referring to FIG. 1, there is shown a diagram of a person 10 having an ear with an earlobe 11 supporting a ear piece 12, commonly called an earring. Earlobe 11, shown as being pierced, has a hole 19 to support the ear piece 12 on the lower portion thereof. Ear piece 12 has a stylish shaped body 9 comprising a generally flat metal member having a curved tear-drop shape supporting a plurality of decorative items 13, such as gems, stones, glass, or the like. The decorative items 13 are located on the front or outside surface 14 of body 9. The back or inside surface 15 of body 9 is located adjacent the earlobe 11. A cylindrical post 16 is secured to the mid-section of body 9 and extends away from inner surface 15. The outer end of post 16 has a circular end 20 as seen in FIGS. 5 and 7. The body 9 and post 16 are conventional metal members of a pierced earring. A conventional metal clamp unit is normally mounted on post 16 to retain the ear piece on earlobe 11. The metal of body 9 and post 16 as well as the metal of the clamp unit can irritate the skin and react with the body fluids and tissue so that the wearer cannot tolerate metal earrings.

Figure 4:
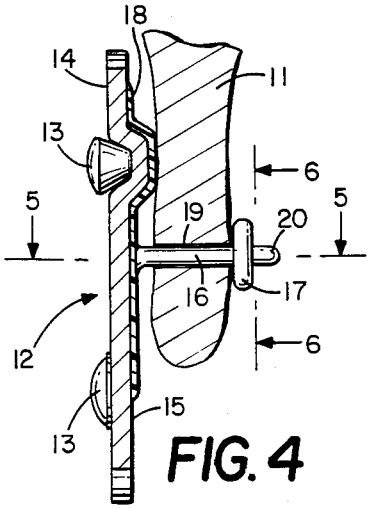
FIG. 4 is an enlarged sectional view taken along the line 4—4 of FIG. 2.

As shown in FIGS. 4 and 5, post 16 has a uniform cylindrical shape and extends from the back side 15 of body 9 through hole 19 of earlobe 11. An annular holder 17 mounted on post 16 around coating 18 thereon to retain the post in assembled relation with earlobe 11. A non-metallic organic coating or layer 18, such as a plastic, is secured to back side 15 and covers post 16. The coating 18 is applied as a liquid with a conventional brush or applicator to the metal parts of the earring that are normally adjacent the skin of earlobe 11. The plastic is preferably biologically inert and does not react with the skin tissue or body fluids and does not mechanically irritate the earlobe. Preferably, the plastic is transparent so that it does not detract from the ornamental and beautification characteristics of the earring. The plastic is compressible. The plastic is also immune from protein build-up that can cause a reaction with the skin tissue. The plastic coating prevents metal allergies of a person's skin. An example of the plastic is a mixture containing trichlorethane, toluene, and 2-methoxyethanol. This material is normally a liquid state and stored in closed containers. The material is applied to the jewelry with a small brush or an applicator. It is spread as a coating evenly on the desired areas of the earring and the post. The exposure of the plastic material to atmosphere evaporates the solvents therein causing the material solidify and adhere to the body 9 and post 16. A preferred coating is a mixture containing 1.1.1. trichlorethane, toluene, and 2-methoxyethanol. The plastic material is applied as a relatively even coat so as to shield the metal body and post from the skin. Preferably, after application of the material to the earring, a drying period from 6 to 8 hours will cure the plastic material at normal room temperature.

Referring to FIG. 7, the annular or donut shaped holder 17 is a rubber O-ring that fits over the plastic coating 18 on post 16. The inside diameter of hole 21 of holder 17 is smaller than the outside diameter of the coating 18 on post 16. The holder 17 made of resilient material is circumferentially biased and compresses an annular portion 22 of the coating 18. This retains holder 17 in assembled relation with the post 16 and prevents the accidental separation of holder 17 and loss of the earring 12 from earlobe 11. Holder 17 is made of a rubber or elastic material that is biologically inert and does not irritate skin tissue and does not react with the body fluid. The surfaces of holder 17 are smooth so as not mechanically irritate the skin tissue. Holder 17 can be readily removed from post 16 by pulling the holder off the post. The earring 12 can then be removed from earlobe 11.

While there have been shown and described preferred embodiments of the earring having a metal body and a metal post and a preferred non-metallic organic coating or layer that shields the metal from skin tissue and body fluids, it is understood that changes in the design and configuration of the earring and changes in the coating material may be made by those skilled in the art without departing from the invention. The invention is defined in the following claims.

I claim:

1. A device adapted to be carried by a person adjacent his or her skin comprising: a body that can irritate a person's skin, holding means secured to the body for holding the body adjacent the skin of a person, and coating means attached to said body and holding means to shield the skin from the body and holding means, said coating means comprising a mixture of trichlorethane, toluene, and 2-methoxyethanol forming a coating material that is a non-irritant to a person's skin.

2. The device of claim 1 where: the body is a metal earring having a surface locatable adjacent the skin of a person.

3. The device of claim 2 wherein: the holding means includes a post secured to said surface of the body, said material covering said surface and post.

4. The device of claim 3 wherein: the holding means includes annular means mounted on and surrounding the post.

5. The device of claim 4 wherein: said annular means having a circular wall surrounding a hole, said hole having a size smaller than the transverse size of the post and coating material thereon, said circular wall deforming said coating material to retain the annular means on said post.

6. The device of claim 5 wherein: the annular means is an O-ring.

7. The device of claim 1 wherein: the coating material is a mixture of 1,1,1-trichlorethane, toluene and 2-methoxyethanol.

8. The device of claim 1 wherein: the body is the casing of a watch and a watchband, said coating means being attached to said casing and watchband.

9. The device of claim 1 wherein: the body is a ring, said coating means being attached to ring.

10. An earring for an ear having a portion thereof with a hole comprising: a body having front and back sides, the front side locatable away from the ear and the back side locatable adjacent the ear, post means secured to the body and extended normally from the back side of the body for selectively traversing the ear through the hole therein, non-metallic and non-skin irritating coating means secured to back side of the body and covering the post means to shield skin areas from the body and post means to prevent irritation of the skin, said coating means comprises a mixture of trichlorethane, toluene, and 2-methoxyethanol forming a coating material that is a non-irritant to a person's skin, and non-skin irritating means slidably engageable over the coating means on the post means to retain the earring in the ear.

11. The device of claim 10 wherein: the coating means comprises a mixture of 1,1,1-trichlorethane, toluene and 2-methoxyethanol.

12. The device of claim 10 wherein: the means to retain the earring on the ear comprises a resilient annular means having a hole to accommodate the post means and coating means thereon, said hole having a size smaller than the transverse size of the post and coating means thereon, said annular means deforming said coating means to retain the annular means on said post means.

13. The device of claim 12 wherein: the annular means is an O-ring.

14. The device of claim 12 wherein: the coating material is a mixture of 1,1,1-trichlorethane, toluene and 2-methoxyethanol.

15. A device adapted to be carried by a person adjacent his or her skin comprising: a body, a generally cylindrical post means made of metallic material that can irritate a person's skin attached to the body, coating means attached to said body and post means to shield the skin from the body and post, said coating means comprising plastic material that is compressible and a non-irritant to the person's skin and an O-ring of elastic material that is biologically inert and does not irritate a person's skin, said O-ring having a hole smaller in diameter than the outside diameter of the coating means on the post means whereby the O-ring compresses a continuous annular portion of the coating means on the post means when the O-ring is placed about said post means to retain the O-ring on said coating means on said post means.

16. The device of claim 15 wherein: the coating material is a mixture of trichlorethane, toluene, and 2-methoxyethanol.

17. The device of claim 15 wherein: the coating material is a mixture of 1,1,1-trichloroethane, toluene, and 2-methoxyethanol.

18. The device of claim 15 wherein: the body is a metal earring having a surface locatable adjacent the skin of a person.

* * * * *